United States Patent [19]

May

[11] 4,268,386

[45] May 19, 1981

[54] SWIMMING POOL ACCESSORY

[76] Inventor: Michael A. May, Gay Bowers Farm, West Hanningfield, Chelmsford, Essex, England

[21] Appl. No.: 8,879

[22] Filed: Feb. 2, 1979

[30] Foreign Application Priority Data

Feb. 7, 1978 [GB] United Kingdom ..... 4840/78

[51] Int. Cl.[3] ..... E04H 3/20; B01D 35/02

[52] U.S. Cl. ..... 210/169; 210/323.2; 210/416.2

[58] Field of Search ..... 210/169, 447, 448, 323 T, 210/459, 416 AS, 493 R

[56] References Cited

U.S. PATENT DOCUMENTS

| | | | |
|---|---|---|---|
| 3,036,712 | 5/1962 | Barbara | 210/169 |
| 3,090,489 | 5/1963 | Smith | 210/169 |
| 3,864,262 | 2/1975 | Lang et al. | 210/169 |
| 4,022,690 | 5/1977 | Smith | 210/169 |

*Primary Examiner*—William A. Cuchlinski, Jr.

[57] ABSTRACT

According to the invention there is provided, in a swimming pool a ladder, having hollow stiles and a skimmer box connected to one of the stiles and a filter unit preferably connected between the skimmer box and the said one stile. The skimmer box and filter unit are located on the ladder so that they are between the stiles and lie between the rungs and the wall of the pool when the ladder is in use.

5 Claims, 5 Drawing Figures

SWIMMING POOL ACCESSORY

This invention relates to swimming pool accessories and in particular to a pool ladder in which the ladder stiles are usable as conduits for water flowing to and from the pool.

United Kingdom Patent Specification No. 1,163,186 describes and claims a ladder incorporating a skimmer in which the water flow from the skimmer is drawn out via one of the ladder stiles to piping leading to a more or less remote pump and filter and returned to the pool via further piping and the other stile.

According to the present invention there is provided a swimming pool accessory comprising a pool ladder having hollow stiles suitable for use as conduits for water flowing to and from the pool, a skimmer box and a filter unit mounted on the ladder and connectable so that in use water skimmed off into the skimmer box passes into one of the stiles and may be returned to the pool via the other stile, the skimmer and the filter unit being mounted so that in use they lie between the ladder and the wall of the pool, and the water passing through the filter after leaving the skimmer box and before returning to the pool.

The filter is thus housed in an area which would otherwise be wasted space and does not take up space in a separate pump area, as is normal.

Preferably, the skimmer box and filter unit are combined in a single casing and connected so that the water passes from the skimmer box to the filter unit and thence to the said one stile.

Conveniently, the filter unit is of a cartridge type consisting of one or more removably mounted cylindrical filter cartridges. Such cartridges may for instance consist of accordion-pleated filter paper in the form of a cylinder. A number of such cartridges, to suit the size of the pool and the flow requirement would be arranged in parallel, and would feed filtered water into a header box, forming part of the filter unit, connected to the said one stile.

The filter unit may also include a basket for retention of leaves and other relatively coarse debris upstream of the cartridges.

Provision may also be made for connection of a suction cleaner to the upstream side of the filter unit.

The invention will be further described with reference to the accompanying drawings, which show a preferred embodiment of the invention.

In the drawings:

FIG. 1 is a side elevation of a preferred form of swimming pool accessory according to the present invention;

FIG. 1*a* is a diagram showing other accessories in circuit with the accessory of FIG. 1.

Figures 1, 1A:
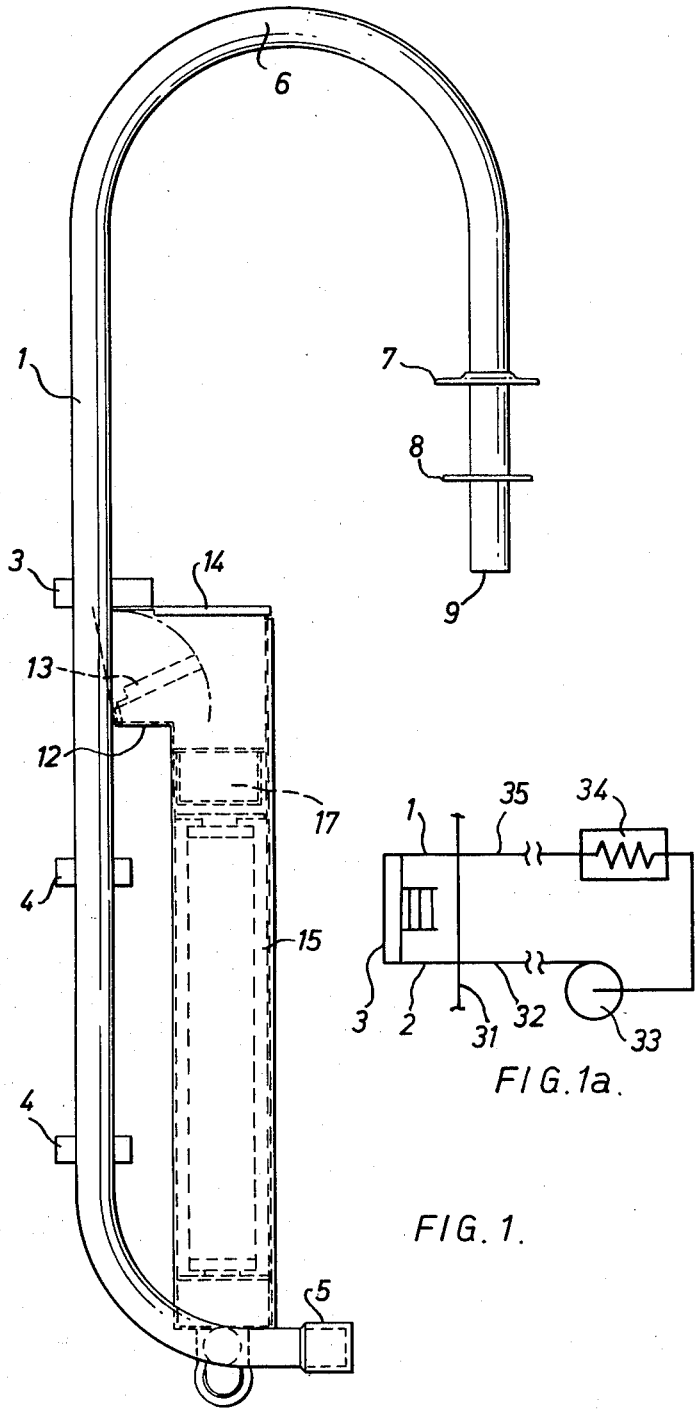

As illustrated, the accessory is in the form of a swimming pool ladder having stiles 1 and 2 which are of tubular stainless steel, and as such are suitable for use as conduits. The ladder also includes a top step 3 and two other steps 4. The lower ends of the stiles are closed off by elastomeric buffers 5 which in use abut on the pool wall 31, while the upper ends of the stiles are curved into return bends 6 and have fixing plates 7 and 8, while the free open ends 9 are arranged to be used as take-off points to piping 32 leading to an external pump 33. The stile 1 is connected to the suction side of the pump 33, which passes water through a heater 34, and the stile 2 takes water from the return piping 35 and passes it back to the pool via apertures illustrated at 11.

A skimmer box 12 having a floating weir 13 of generally conventional form, which does not need to be described in detail, is mounted on the underside of the top step 3 between and behind the stiles 1 and 2. The skimmer box 12 has a removable lid 14 and extends downwards to form a filter unit casing 15.

Figure 5:
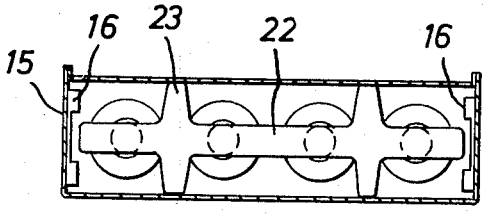
FIG. 5 is a section taken along the line V—V of FIG. 4, with one component removed for clarity of illustration.

At the top of the filter unit casing 15, there are provided lugs 16 for supporting a basket 17 (omitted from FIG. 5 for clarity of illustration), which collects leaves and other coarse debris which pass into the skimmer box 12. This basket 17 is removable for emptying, and access to it and the underlying filter arrangements are through the lid 14.

Figure 2:
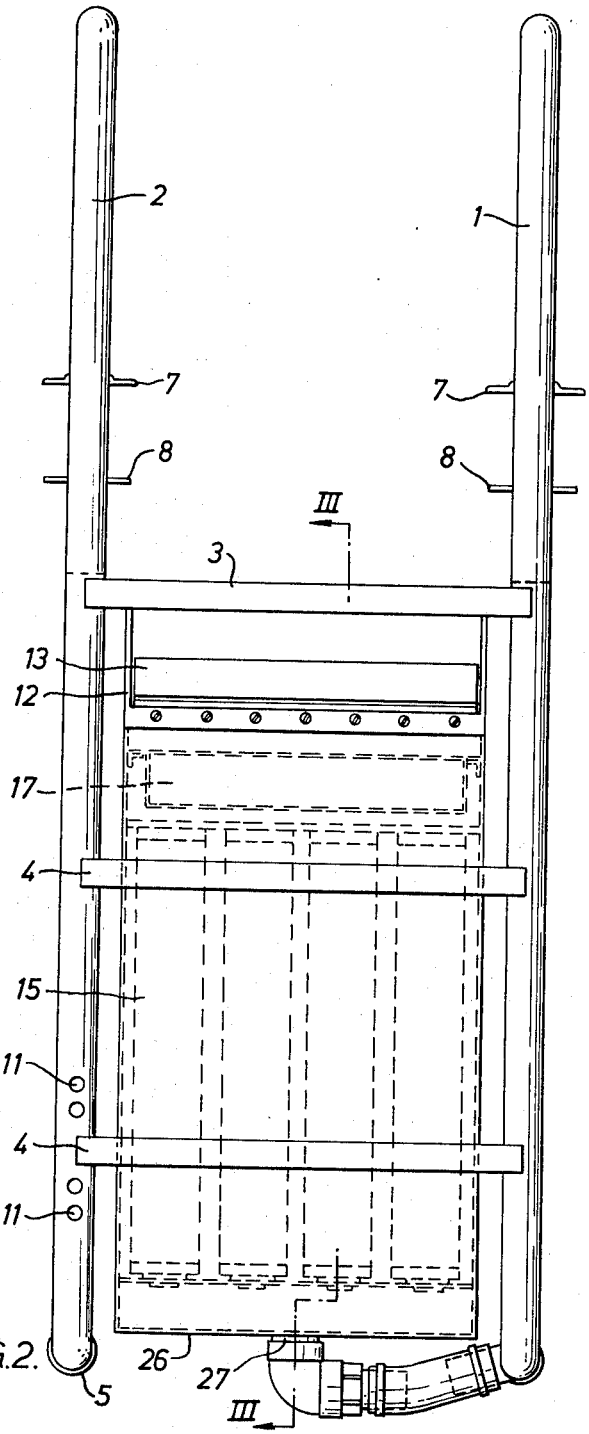
FIG. 2 is a front elevation of the accessory of FIG. 1.
Figure 3:
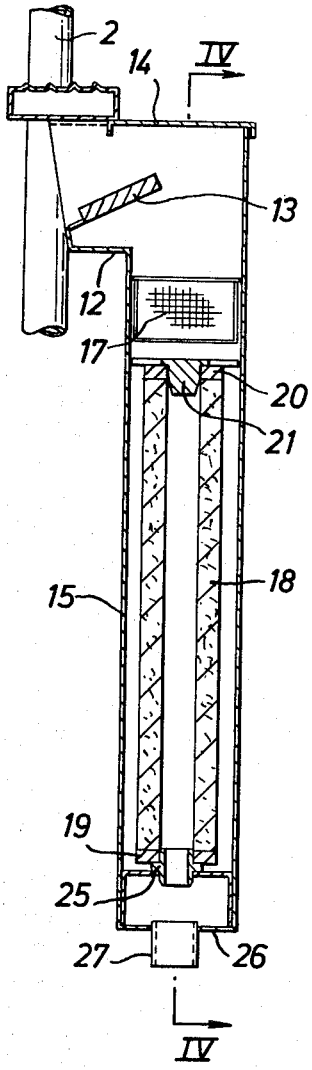
FIG. 3 is a section on the line III—III of FIG. 2.
Figure 4:
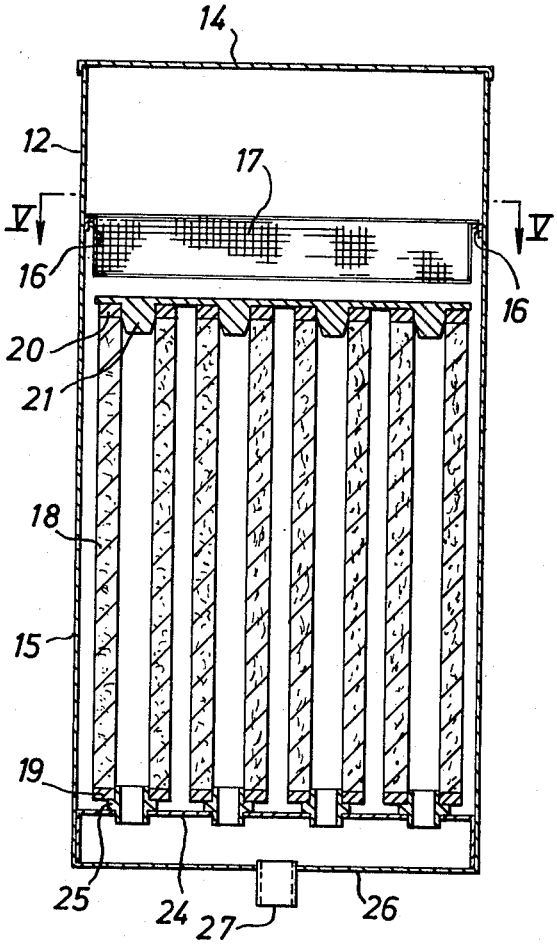
FIG. 4 is a section on the line IV—IV of FIG. 3.

Below the basket 17, there are provided a plurality, in the case illustrated four, of filter cartridges 18 in the form of cylindrical arrangements of accordion-pleated filter paper extending between annular end members 19 and 20. The upper ends of the filter cartridges, adjacent the end members 20, are closed by a series of plugs 21 formed integrally with a support and spacing member 22 which has laterally extending arms 23 to limit its movement. This member 22 may be formed in a suitable plastics material. The filter unit housing 15 has a partition wall 24 having an aperture associated with each of the filter cartridges, and in each of these apertures there is provided a plugging and location member 25, also of a suitable plastics material, which provides an upstanding boss cooperating with the end member 19 of the cartridge, and also prevents by-passing of water. A bottom wall 26 of the housing 15 forms with the partition wall 24 a header box connected with the insides of the filter cartridges and having an outlet connection 27 which is connected, as illustrated in FIG. 2, to the stile 1.

In use, water flows over the floating weir 13 into the skimmer box 12 and through the basket 17 into the filter unit housing 15. At this point, it is outside the filter cartridges 18 and it flows through the cartridges 18 and thence through the members 25 into the header box and then via the connection 27 to the stile 1 which is connected to the suction side of the pump 33. Water is returned from the pump 33 to the stile 2 and via the apertures 11 to the pool.

When the filters become clogged, the lid 14 may be removed and the basket removed for emptying and the filter cartridges are removed for cleaning and/or replacement.

It will be appreciated that the location of the filters in between the ladder and the wall of the pool makes use of space which is not really otherwise usable and saves space for bulky filters which would otherwise have to be housed in the pump buildings, along with the heating equipment.

The basket 17 is set somewhat down in the filter unit housing 15, this is to enable introduction above the basket of a plate having edge sealing gaskets which will rest on the basket and has a connection thereon for conventional suction cleaner hose. Thus, with the pump running, the suction available above the basket may be utilised via the conventional suction cleaner to clean the bottom and side walls of the pool, the dirt being collected either in the basket 17 or on the filter cartridges.

The hose may either be introduced over the weir or through the aperture left by removal of the lid 14.

Various modifications may be made within the scope of the invention. Thus, although the skimmer box is shown as connected to the filter, which is thus on the suction side of the pump, it is possible for the skimmer box to be connected to the stile 1 on the suction side of the pump 33 and for the filter unit to be fed from the other 2 and to discharge into the pool, thus being a pressure filter.

I claim:

1. A swimming pool accessory comprising a pool ladder having hollow stiles suitable for use as conduits for water flowing to and from the pool, a unitary skimmer box and filter unit mounted on the ladder and connected to said stiles so that in use water skimmed off the skimmer box passes into one of the stiles and is returned to the pool via the other stile, the water passing through the filter before returning to the pool, the unitary skimmer box and filter unit being mounted on the ladder so that in use it is positioned between the ladder and the wall of the pool and the top of the skimmer box has a removable lid that abuts the top rung of the ladder.

2. A swimming pool accessory as claimed in claim 1, wherein the skimmer box and filter unit are connected so that the water passes from the skimmer box to the filter unit and thence to one stile.

3. A swimming pool accessory as claimed in claim 1 in which the filter unit is of a cartridge type consisting of one or more removably mounted cylindrical filter cartridges.

4. A swimming pool accessory as claimed in claim 3, in which the or each cartridge consists of accordion-pleated filter paper in the form of a cylinder.

5. A swimming pool accessory as claimed in claim 1 in which provision is made for connection of a suction cleaner to the upstream side of the filter unit.

* * * * *

UNITED STATES PATENT OFFICE
CERTIFICATE OF CORRECTION

Patent No. 4,268,386 Dated May 19, 1981

Inventor(s) Michael Axton May

It is certified that error appears in the above-identified patent and that said Letters Patent are hereby corrected as shown below:

On the Title page, Item [76] should read:
[76]..MICHAEL AXTON MAY, dec'd.
Chelmsford, Essex
England
On the Title Page, Item [73] should read:
[73] Assignee: MICHAEL DAVID ARTHUR MAY and
PETER EDWIN STEGGLES,
Executors of the Estate of
Michael Axton May, deceased.

Signed and Sealed this

*Fifteenth* Day of *December 1981*

[SEAL]

*Attest:*

GERALD J. MOSSINGHOFF

*Attesting Officer* *Commissioner of Patents and Trademarks*